US005320368A

United States Patent [19]

Lang

[11] Patent Number: 5,320,368

[45] Date of Patent: Jun. 14, 1994

[54] CURVED SPEED SKATE BLADE

[76] Inventor: Edmund W. Lang, 78 Jason St., Arlington, Mass. 02174

[21] Appl. No.: 23,963

[22] Filed: Feb. 26, 1993

[51] Int. Cl.[5] ..... A63C 1/00
[52] U.S. Cl. ..... 280/11.12; 280/841
[58] Field of Search ..... 280/841, 11.12, 7.13

[56] References Cited

PUBLICATIONS

"All You Wanted to Know About Blades But," by Mike Murray, *Skaters Edge Magazine,* Nov. 1992, p. 6.
"Are You Off Your Rocker," by Ian Hennigar, *Skaters Edge Magazine,* Dec. 1991, p. 7.

*Primary Examiner*—Richard M. Camby
*Attorney, Agent, or Firm*—Lahive & Cockfield

[57] ABSTRACT

The invention relates to blades for speed skating on ice. These blades are attached to speed skating boots, and are shaped with related combinations of radius and bend.

7 Claims, 4 Drawing Sheets

CURVED SPEED SKATE BLADE

This invention relates to ice speed skating and to an improved shape of blades suitable therefore.

BACKGROUND OF THE INVENTION

It is common knowledge that a blade for ice skating will not turn unless it has a convex curvature along the bottom of the blade, called the radius, rock or rocker. It is further understood that a blade with more curved radius will turn more easily but glide less far.

Speed skate blade radius usually varies over the length of the blade, and is more curved at the toe and heel. Radius in the middle of the blade usually is more curved than the turn radius of the racing track.

Published material emphasizes the importance of having a convex speed skate blade radius in the range of six to nine meters when skating around a track with eight meters radius.

Speed skate racing is done with turns only in the counter-clockwise direction. Skate boots and blades for some events are adjusted to take advantage of this fact. Blades are mounted on boots with an offset to the left and some blades are positioned to the left in their support structure.

Blades of expert skaters are also bent to the left. Bending is done with mallet, vise or tool until the blade "looks right" or "feels right". The toe of the blade may be bent so the blade turns more sharply when a skater's weight moves forward. The heel of the blade may be bent so the blade turns more sharply when the skater's weight moves back. The whole blade may be bent in a smooth arc for increased ice contact and stability.

Published material treats bend as a matter of individual preference appropriate only for highly skilled skaters. Bend is considered separately from radius, and most skaters are actively discouraged from using bent blades.

SUMMARY OF THE INVENTION

It is now feasible to shape a speedskating blade with consistent and related combinations of radius and bend so that each segment of the entire blade length makes a path of the same curvature on ice at maximum blade lean angle with no twisting force.

The blade segment shape is determined by the application of a set of formulae which relate blade radius and bend to blade and force angles, cut into the ice, and path traveled on the ice.

Through the application of these formulae, blades for each category of maximum skater speed can be shaped to follow a specific curved path with maximum stability and minimum friction.

The curved ice path carved by an inventive blade has a radius greater than the radius of the racing track, and middle and rear blade segments have very little cut into the ice. The consistent radius and extended ice contact length improve stability and reduce friction for a skater turning at highest speed.

Therefore, in accordance with the present invention, there is provided a curved speed skate blade attached to each speed skate boot; characterized in that each blade has particular related combinations of blade radius and bend suitable for a skater's maximum speed and racing track radius.

BRIEF DESCRIPTION OF THE DRAWINGS

In order that the reader may gain a better understanding of the present invention, certain preferred embodiments thereof will be hereinafter described with reference to the accompanying drawings in which.

DESCRIPTION OF PREFERRED EMBODIMENTS

Figure 1:
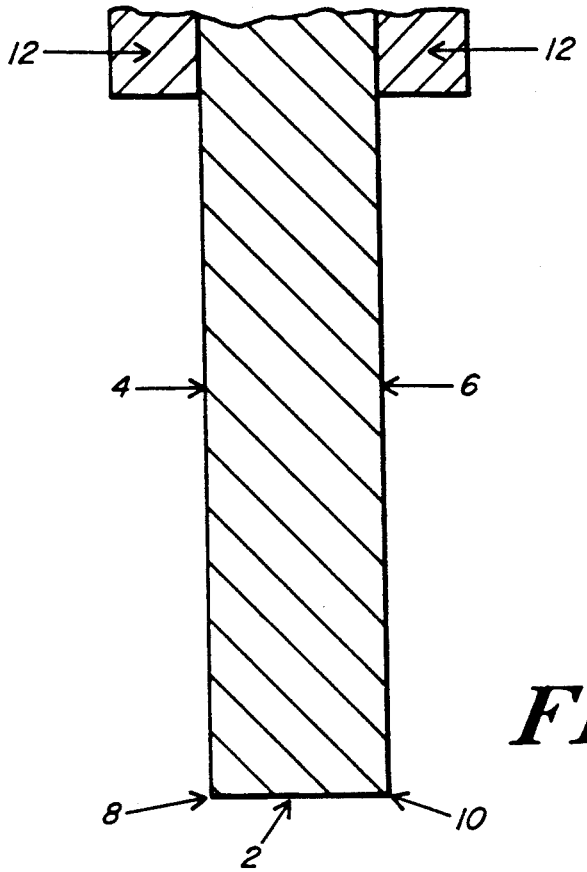
FIG. 1 is a cross-section view of a typical speed skating blade.

FIG. 1 is a cross-section forward view of a typical speed skating blade.

The blade has a flat bottom surface (2) typically 0.8 to 1.4 millimeters across.

Blade left (4) and right (6) sides are usually parallel to each other and perpendicular to the bottom surface at the left (8) and right (10) edges.

The blade fits into a metal support structure (12) between 1 and 3 centimeters up from the bottom surface, and this support (12) is attached to a tube or box-shaped larger support which is ultimately attached to a skate boot.

Figure 2:
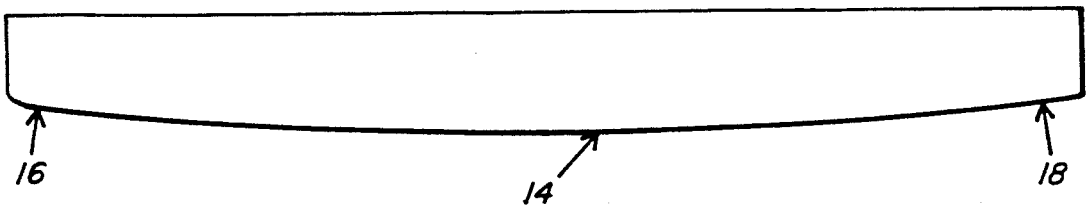
FIG. 2 is a side view showing blade radius.

FIG. 2 is a side view of a typical speed skating blade with bottom surface convex curvature from the toe (16) of the blade to the heel (18). That convex curvature is the blade radius (14), referred to as (R), which can vary along the length of the blade.

Blade radius (14) is typically in the range of 5 to 25 meters.

Blade length, from front of toe (16) to rear of heel (18), is typically 14 to 19 inches.

Figure 3:
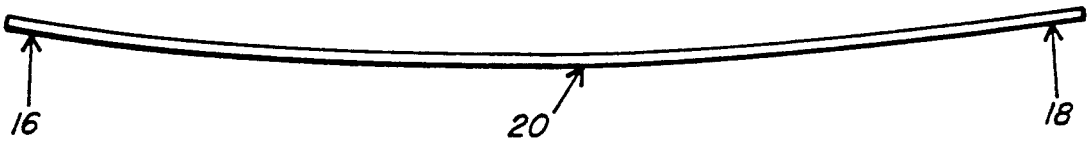
FIG. 3 is a bottom view showing blade bend.

FIG. 3 is a bottom view of a typical expert skater blade, showing some blade bend (20) curvature, referred to as (B), along the length of the blade. Blade bend (20) is to the left, in the same direction as the turn when the blade bottom is in contact with the ice.

The inventive blade has a bend (20) of specific value related to the blade radius in each segment of blade length.

Figure 4:
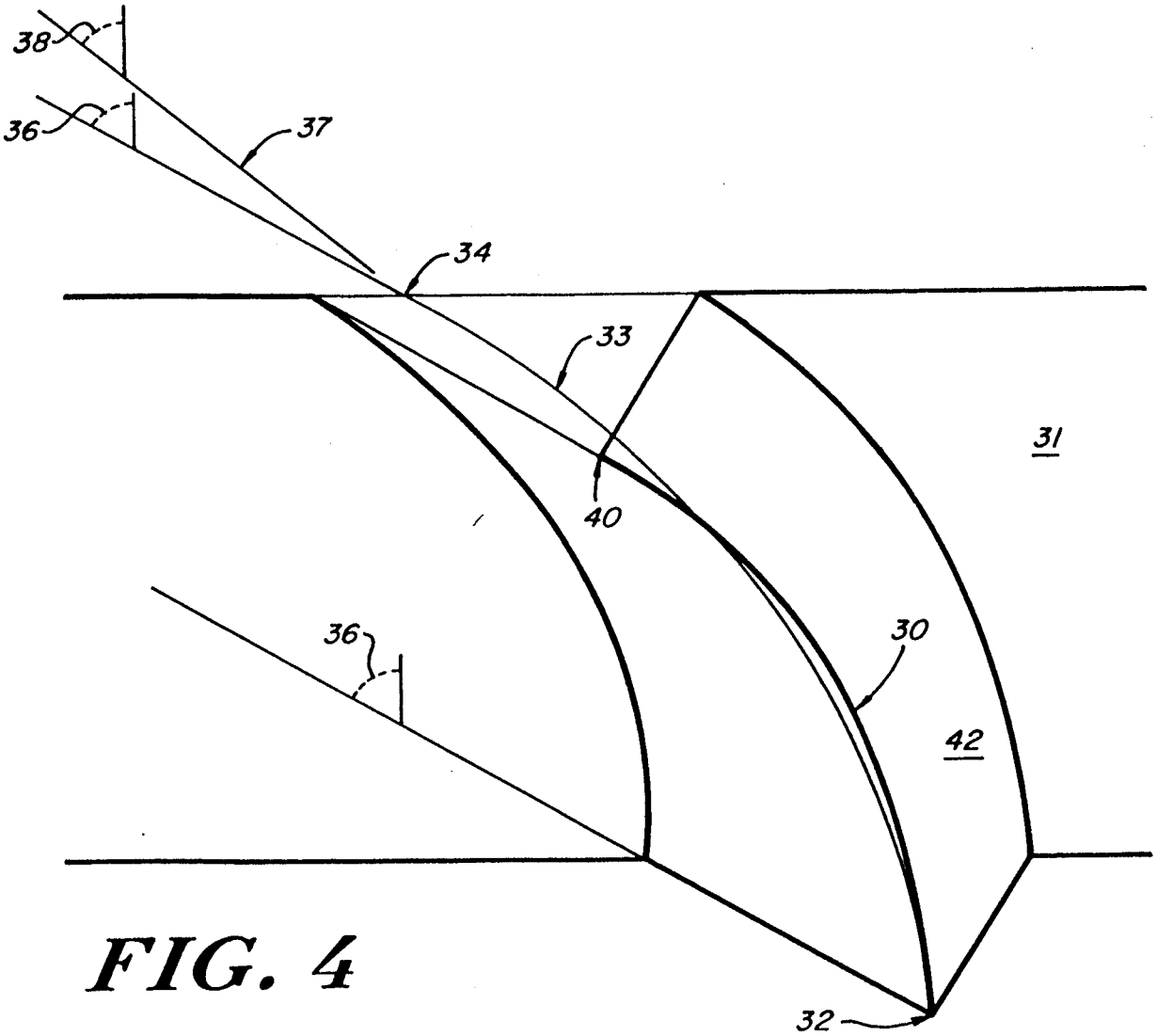
FIG. 4 is a three-dimensional view of a segment of blade edge cutting into the ice.

FIG. 4 is a 3-dimensional view forward of a bent blade segment left edge cutting a groove (30) in the ice surface (31) as the blade moves forward.

The rear-most contact point (32) of the left blade edge is at the bottom of the groove (30) that the blade makes in the ice as it travels forward.

From the rear-most contact point (32), the blade edge (33) curves up and to the left as a result of the blade radius and bend, to a forward ice contact position (34).

The blade side is tilted to the left at an angle (36), referred to as (A), and force (37) is applied to the blade at a lesser angle (38), referred to as (F), as the blade travels forward.

Force (37) against the left blade edge moving forward over the original forward contact point (34) presses the blade edge down to a point (40) at the bottom of the newly-formed groove.

The resulting ice groove (30) goes from the original rear-most contact point (32) to a new rear-most contact point (40) at some depth below the ice surface.

The blade is held in the groove by the ice of the right hand surface of the groove (42) in contact with the flat bottom surface of the blade and the applied force (37) at an angle (38) more downward than the blade side angle (36).

Figure 5:
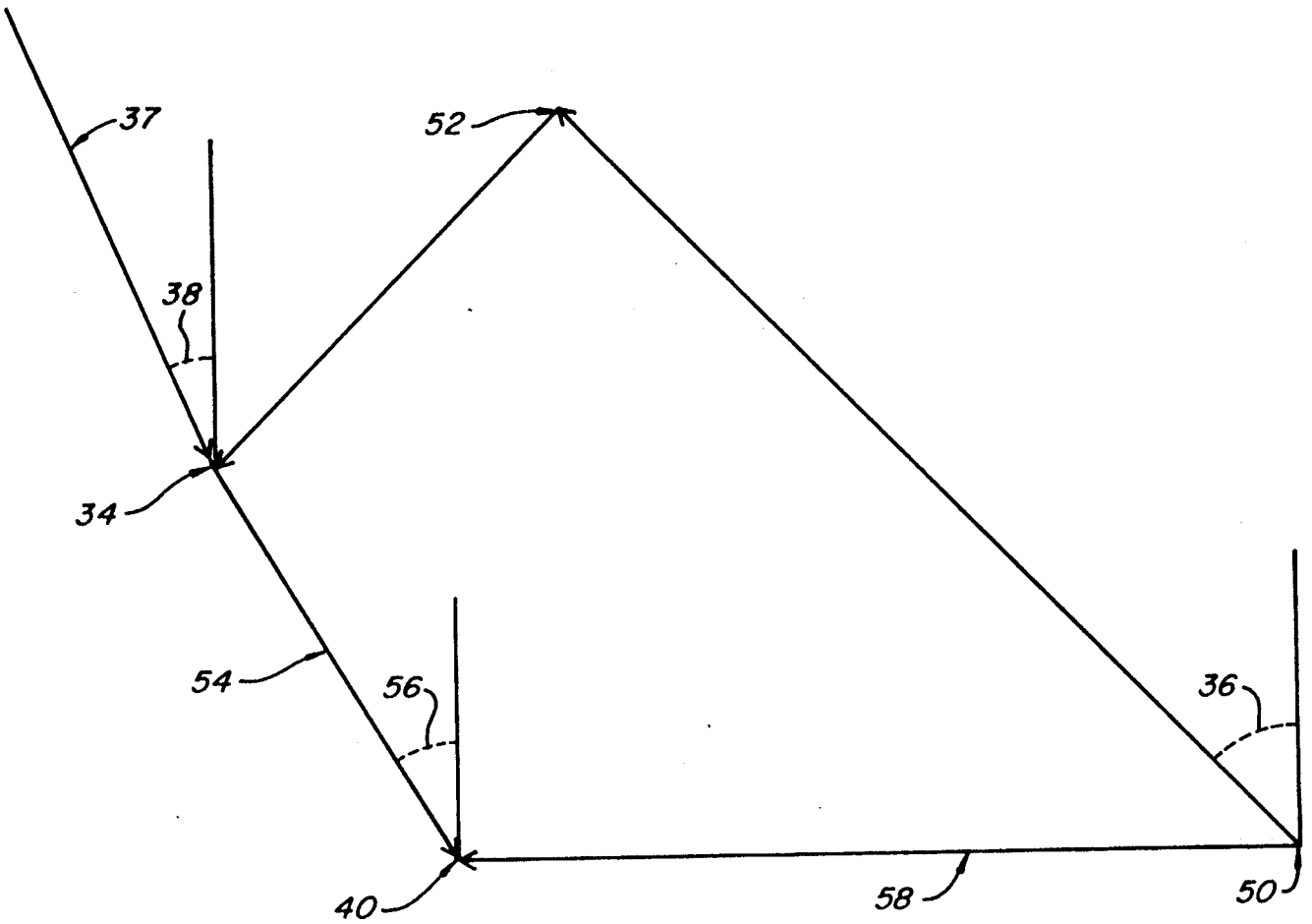
FIG. 5 is a vector diagram of blade edge position some distance forward from the lowest edge position.

FIG. 5 is a vector diagram of the position of an bent blade left edge (34) and later ice groove position (40) some distance forward of the rear-most ice contact point a forward-moving blade.

Starting from the position (50) of an imaginary straight blade edge some distance forward, blade radius places the left blade edge up and left-ward along the blade angle (36) at an imaginary radius-only point (52).

Blade bend places the blade edge down and left-ward in a direction perpendicular to the blade angle (36) from that radius-only point (52) to the initial forward ice-contact position (34).

Force (37) applied to the forward-moving blade at the initial ice-contact position (34) makes a cut (54) in the ice at a angle (56), related to the force (38) and blade (36) angles, to the lowest position (40) in the groove.

This set of vector distances and angles is the basis for the formulae which relate radius and bend in each inventive blade segment to the curved path and cut into the ice.

The horizontal left-ward displacement of the groove, from the straight projection (50) to the final lowest edge position (40), gives a change in direction (58) on the ice equivalent to a circle with a specific radius, referred to as ice radius (I).

The distance from the initial forward contact position (34) to the final lowest position (40) gives a cut (54) into the ice equivalent to a circle with a specific radius, referred to as ice cut (C) at a cut angle (D).

The inventive blade has related radius and bend values along the length of the blade which give the same change in direction (58) for each blade segment.

Figure 6:
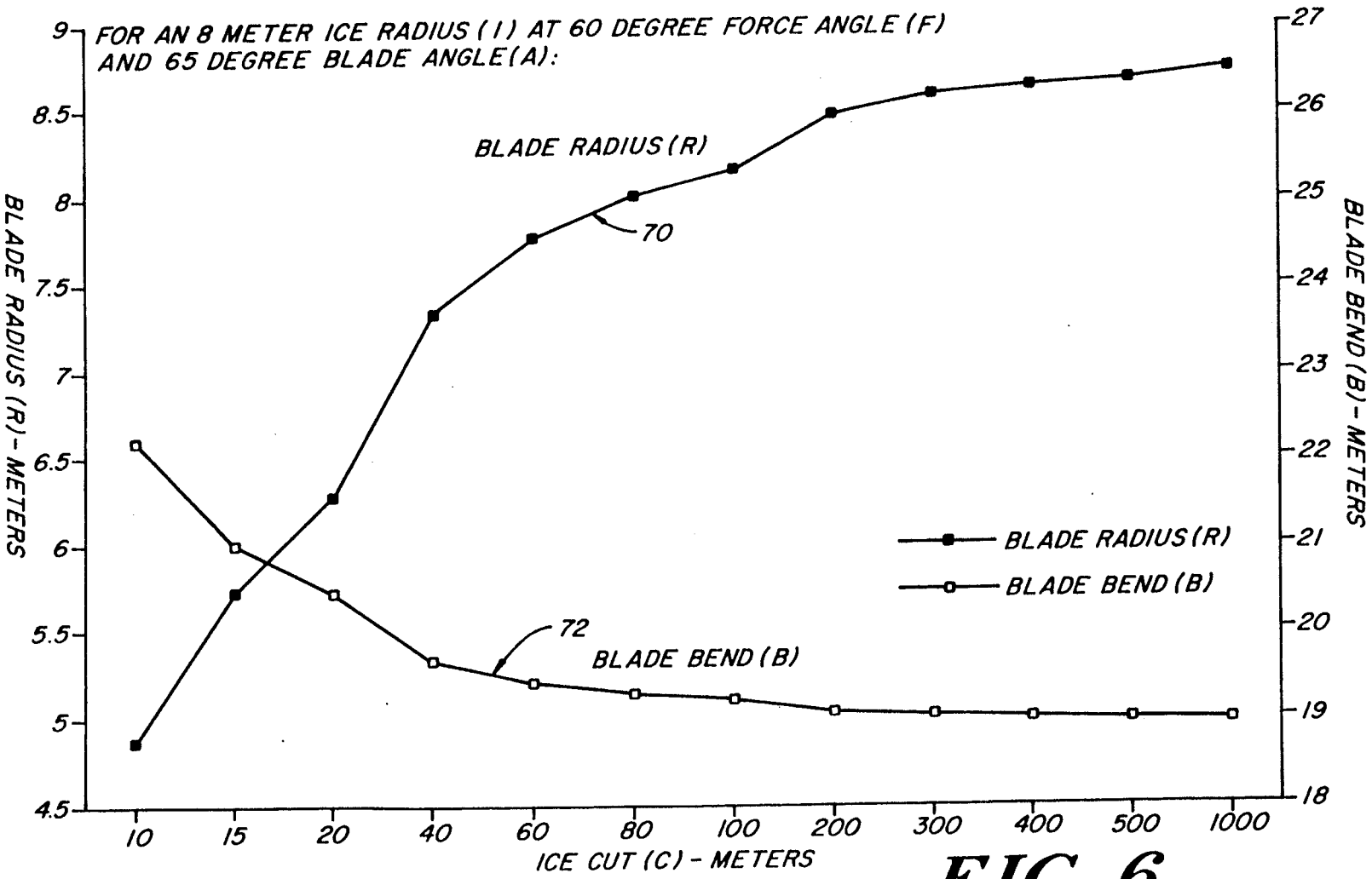
FIG. 6 is a graph giving combinations of blade radius and bend for a single ice radius and blade angle.

FIG. 6 is a graph of radius (R) and bend (B) combinations which can be applied to the segments of one inventive blade. The radius (R) and bend (B) values directly above any ice cut (C) value on the x-axis are a combination which produces the specified ice radius (I) at maximum skater speed. An inventive blade is made up of blade segments which match combinations on one graph.

For the range of ice cut (C) values on the x-axis, blade radius values (70) are read off the left vertical axis, and blade bend values (72) are read off the right vertical axis.

One graph represents all the possible combinations of segment radius (R) and bend (B) for an inventive blade designed to carve one ice radius (I) at one maximum blade lean angle (A). Blade lean (A) and force (F) angles are based on maximum speed and track radius.

Values for each graph are calculated using the formulae for an inventive blade, namely:

$$B=(\cos A+\sin A*\tan A)/(1/I-(\cos F*\tan A-\sin D/C)$$

$$R=1/(\tan A/B+\cos D/(C*\cos A))$$

$$D=A-\arctan(\tan(A-F)/\tan A)$$

For ice cut radius values (C) from 10 meters to 1000 meters on the x-axis, one curve (70) shows the blade radius (R) values and the other curve (72) shows the related blade bend (B) values for an 8 meter ice radius (I) at 60 degree force (F) and 65 degree blade (A) angles.

High (more flat) cut radius (C) values, are appropriate for portions of the blade middle and rear that make almost no additional cut into the groove. A nearly flat ice cut (C), a high cut radius value, results in more blade edge length in contact with the ice, less friction, and more stability.

Low (more curved) cut radius (C) values are appropriate for portions of the blade front that have to face ice irregularities and make the initial groove. A sharper ice cut (C), low radius value, results in less blade edge length in contact with the ice, easier steering and more blade rise above the surface of the ice.

The inventive blade always has a single value for ice radius (I). That ice radius (I) determines the related values of blade radius and bend for the various cut radii (C) that can be chosen for different blade segments.

The first method for making an inventive blade starts with a normal blade which has some initial blade radius (R) and may or may not have any bend (B). This blade is modified to produce a single consistent ice radius (I) over its whole length, with more flat ice cut (C) in the rear.

1. Specify the desired ice performance characteristics.

Ice radius (I)—how tight the blade should turn on the ice. Ice radius (I) of an inventive blade is 0 to 50 percent greater than the inside radius of the racing track.

Maximum force (F) angle is derived from skater maximum speed around a turn of specific radius.

Ice cut (C)—how curved the edge of the blade should be making the groove at the toe of the blade, and how flat at the middle and heel of the blade. Ice cut (C) of an inventive blade is curved enough at the toe to ride over ice surface irregularities, and quite flat at the middle and heel.

2. Select a version of the FIG. 6 chart based on the value of ice radius (I) and force angle (F) selected in step 1 above.

3. Draw three vertical lines through the x-axis of the chart at the ice cut (C) radii selected in step 1 above for the toe, middle and heel of the blade.

4. Adjust the blade radius (R) to equal the values at the intersection of the vertical lines and the blade radius curve.

Blade radius can be set using a commercially available blade radius machine.

Blade radius can also be adjusted by hand, using a diamond sharpening stone on blades set in a normal speed skate sharpening jig.

A radius measuring device is used to check the accuracy of the machine or adjustment.

A typical measuring device measures either blade radius or bend over a 3½ inch span according to a dial indicator showing height in 1/10000 inch increments.

5. Adjust the blade bend (B) to equal the value on the chart that matches the measured radius at each point along the blade.

Blade bend (B) can be added or reduced by flexing the blade support with a Zandstra blade-straightener tool or by flexing the entire blade support structure in a vise.

Resulting bend (B) is measured with a measuring device, and the process is repeated until the desired bend is achieved.

6. The end result is a blade with inventive characteristics of a single ice radius (I) and a selected range of ice cut (C) radii, giving directional consistency, stability and reduced friction at maximum force (F) and blade (A) angles.

A second method of making an inventive blade is to add bend (B) to an existing blade, so that an acceptable ice radius (I) is achieved. Ice cut (C) is allowed to vary according to the blade's original radius (R).

1. Start with a FIG. 6 chart for an acceptable ice radius at a maximum blade angle.

2. Measure the existing blade radius and apply the matching bend to achieve the desired ice radius in each segment of the blade.

3. This blade has the inventive characteristic of specifically chosen ice radius (I) for directional consistency, but not provide the benefits of specifically chosen ice cut (C).

4. This method recognizes that blade bend is much easier to change than blade radius. Some blade radius changes can only be made by substantially reducing the blade height.

A third method of making an inventive blade is to include the inventive radius and bend combinations in the manufacturing process and produce various inventive blade models.

1. Inventive blade models can be made for pre-determined skater speed categories and the range of reasonable ice radii (I) and ice cuts (C) as described in the specifications for method one above.

2. Standard inventive blade models for pre-determined skater categories is similar to the current practice of having ski models for pre-determined skier categories.

3. These blade models give the inventive characteristics of consistent ice radius (I) and specified ice cut (C) at maximum force angle (A) to each category of skater.

In all these methods bend may be added by bending the major blade support structure, the portion of the support structure which overlaps the blade or the blade itself.

The Zandstra blade straightening tool is well suited for bending the blade/support overlap.

A vise is better suited for bending the major support, but it is difficult to achieve precise results using this tool alone.

Bending the blade directly is the least desirable method, because the blade is subjected to extra stress as it is bent against its straight support, and because afterward there is no structural support for the bent shape.

In all these methods the actual inventive blade radius and bend approximate the calculated values which produce particular ice performance results. The approximation need not be extremely precise for many of the advantages of an inventive blade to be achieved.

Automated and continuous bending techniques can be used to make inventive blades. Mechanical or optical methods can be used to make blade radius and bend measurements.

Blades which have lost their inventive characteristics through damage or use can have the inventive characteristics restored by re-bending and/or re-radiusing the blades.

Many other variations and modifications can be made to the invention without departing from the spirit and scope thereof as set out in the following claims:

I claim:

1. A blade for speed skating and turning on ice, fittable into a support structure attachable to a skate boot, said blade having a blade length divided into segments, said blade segments constructed with radius and bend, said radius (R) convex in the plane of the blade side, said bend radius (B) in the plane perpendicular to blade side, said bend (B) in the direction of turning, said radius (R) and bend (B) related, said relationship according to application of a formula for ice radius (I) and cut radius (C), where ice radius (I) is the radius of the groove made by the blade, with blade moving forward over the ice, with blade angle (A) from vertical toward the center of the turn, with force applied to the blade edge in contact with ice at force angle (F) from vertical, where cut radius (C) is the radius of a circle formed by the blade edge length pressing into ice, said circle leaning toward center of the turn at cut angle (D) from vertical, said cut angle (D) related to force angle (F) and blade angle (A), said circle tangent to lowest point of ice radius groove, where cut radius (C) describes depth of blade in groove, from lowest point in groove forward, said formula including:

$$D=A-\arctan(\tan(A-F)/\tan A),$$

said formula further including:

$$I=1(\cos A/B+\sin A/R-\tan D(\cos A/R-\sin A/B)),$$

and said formula further including:

$$C=\cos D/(\cos A/R-\sin A/B),$$

said formula giving specific ice radius (I) and cut radius (C) at specific force (F) and blade (A) angles for a blade segment radius (R) and bend (B), said blade segments all having blade segment radius (R) and bend (B) selected so that there is a single ice radius (I) at selected maximum force angle (F) and blade angle (A) said selected blade angle (A) having a magnitude greater than said selected maximum force angle (F).

2. The blade as claimed in claim 1, said blade constructed with an ice radius (I) equal to or greater than the radius of a racing track, having a track radius defined by international rules.

3. The blade as claimed in claim 1, said blade constructed with increasing ice cut radius (C) from the blade toe to the heel.

4. A blade for speed skating and turning on ice, fittable into a support structure attachable to a skate boot, said blade having a blade length divided into segments, said blade segments each making and following a single ice radius (I), where ice radius (I) is the radius of the groove made by the blade segment, with blade moving forward over the ice and no twisting force applied, with blade angle (A) from vertical toward the center of the turn, with force applied to the blade edge in contact with ice at force angle (F) from vertical, said blade segments all having blade segment radius (R) and bend (B) selected so that there is a single ice radius (I) at selected maximum force (F) and blade (A) angles, said radius (R) convex in the plate of the blade side, said bend radius (B) in the plane perpendicular to blade side, said bend (B) in the direction of turning, where ice radius (I) results from a relationship between blade radius (R) and blade bend radius (B) at blade angle (A) and force angle (F), said relationship defined by formula for ice radius (I) and cut radius (C), where cut radius (C) is the radius of a circle formed by the blade edge length pressing into ice, said circle leaning toward center of the turn at cut angle (D) from vertical, said cut angle (D) related to force angle (F) and blade angle (A), said formula including:

$$D=A-\arctan(\tan(A-F)/\tan A),$$

$$C=\cos D/(\cos A/R-\sin A/B),$$

$$I=1/(\cos A/B+\sin A/R-\tan D(\cos A/R-\sin A/B)),$$

said formula giving selected ice radius (I) and cut radius (C) at selected force angle (F) and blade angle (A) for a blade segment radius (R) and bend (B), said selected blade angle (A) having a magnitude greater than said selected force angle (F).

5. The blade as claimed in claim 4, said blade segments all having blade segment radius (R) and bend (B) selected so that there is an ice radius (I) equal to or up to 80% greater than the radius of a racing track.

6. The blade as claimed in claim 4, said blade segments all having blade segment radius (R) and bend (B) selected so that there is an ice radius (I) between 8 and 14 meters when the track turn radius is 8 meters, or between 25 and 40 meters when the track turn radii are 25 and 30 meters.

7. The blade as claimed in claim 4, said blade segments all having blade segment radius (R) and bend (B) selected so that there is an ice radius (I) of 30 meters or more in all blade segments that may come into contact with a flat ice surface when a skater is skating the track turn radius at maximum speed.

* * * * *

UNITED STATES PATENT AND TRADEMARK OFFICE

CERTIFICATE OF CORRECTION

PATENT NO. : 5,320,368
DATED : June 14, 1994
INVENTOR(S) : Edmund W. Lang

It is certified that error appears in the above-indentified patent and that said Letters Patent is hereby corrected as shown below:

In the Claims

In claim 7, column 8, line 22, replace "an ice radius (I) of 30 meters" with -- an ice cut radius (C) of 30 meters --

Signed and Sealed this

Twentieth Day of December, 1994

*Attest:*

Bruce Lehman

BRUCE LEHMAN

*Attesting Officer*

*Commissioner of Patents and Trademarks*